US008496409B2

(12) United States Patent
Aksel et al.

(10) Patent No.: US 8,496,409 B2
(45) Date of Patent: Jul. 30, 2013

(54) MARINE RISER TENSIONER

(75) Inventors: Bulent Aksel, Houston, TX (US); Joseph William Pallini, Jr., Tomball, TX (US); Steven Matthew Wong, Houston, TX (US); Tsorng-Jong Maa, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 97 days.

(21) Appl. No.: 13/072,233

(22) Filed: Mar. 25, 2011

(65) Prior Publication Data

US 2012/0207550 A1 Aug. 16, 2012

Related U.S. Application Data

(60) Provisional application No. 61/442,073, filed on Feb. 11, 2011.

(51) Int. Cl.
*B63B 21/00* (2006.01)

(52) U.S. Cl.
USPC ..... 405/224.4; 405/224.2; 166/355

(58) Field of Classification Search
USPC ..... 405/224, 224.2, 224.4; 166/355
See application file for complete search history.

(56) References Cited

U.S. PATENT DOCUMENTS

| | | | | |
|---|---|---|---|---|
| 3,871,622 | A | 3/1975 | Larralde et al. | |
| 4,100,752 | A | 7/1978 | Tucker | |
| 4,379,657 | A | 4/1983 | Widiner et al. | |
| 4,787,778 | A | 11/1988 | Myers | |
| 4,799,827 | A | 1/1989 | Jaqua | |
| 5,069,488 | A | 12/1991 | Freyer et al. | |
| 5,310,007 | A * | 5/1994 | Parikh | 166/355 |
| 5,366,324 | A | 11/1994 | Arit | |
| 5,551,803 | A | 9/1996 | Pallini, Jr. et al. | |
| 6,260,625 | B1 * | 7/2001 | Phan et al. | 166/355 |
| 6,688,814 | B2 * | 2/2004 | Wetch et al. | 405/224.2 |
| 6,746,182 | B2 | 6/2004 | Munk et al. | |
| 7,112,011 | B2 | 9/2006 | McCarty et al. | |
| 7,217,067 | B2 | 5/2007 | Mao | |
| 7,329,070 | B1 | 2/2008 | Trent | |

(Continued)

FOREIGN PATENT DOCUMENTS

| | | |
|---|---|---|
| EP | 0088608 A3 | 7/1983 |
| EP | 0088608 A2 | 9/1983 |

(Continued)

OTHER PUBLICATIONS

GB Search Report dated Apr. 3, 2012 from corresponding Application No. GB1202207.5.

*Primary Examiner* — David Bagnell
*Assistant Examiner* — Benjamin Fiorello
(74) *Attorney, Agent, or Firm* — Bracewell & Giuliani LLP

(57) ABSTRACT

A push-up tensioner for maintaining a tensile force in a riser having an axis couples to a floating platform and maintains the tensile force while the riser tilts variably from the vertical. The tensioner includes a plurality of cylinders having a lower end pivotally coupled to the deck. The cylinders are substantially perpendicular to the deck in the running position and at an angle to the deck in the tensioning position. After running of the riser, a placement assembly moves the cylinders from the running position to the tensioning position. A tensioner ring is run on the riser proximate to an upper end of the cylinders, and the cylinders are then automatically coupled to the tensioner ring.

18 Claims, 15 Drawing Sheets

U.S. PATENT DOCUMENTS

| | | | | |
|---|---|---|---|---|
| 7,334,967 | B2 | 2/2008 | Blakseth et al. | |
| 7,632,044 | B2 | 12/2009 | Pallini et al. | |
| 7,708,498 | B2 | 5/2010 | Ellis | |
| 2005/0074296 | A1 | 4/2005 | McCarty | |
| 2005/0129464 | A1 | 6/2005 | Moncus | |
| 2005/0147473 | A1 | 7/2005 | Pallini et al. | |
| 2006/0280560 | A1 | 12/2006 | Ellis et al. | |
| 2007/0056739 | A1 * | 3/2007 | Ellis | 166/355 |
| 2009/0145611 | A1 | 6/2009 | Pallini et al. | |

FOREIGN PATENT DOCUMENTS

| | | | |
|---|---|---|---|
| WO | 2004013452 | A1 | 2/2004 |
| WO | 2009064941 | A2 | 5/2009 |
| WO | 2011133552 | A1 | 10/2011 |

* cited by examiner

MARINE RISER TENSIONER

This application claims the benefit of U.S. Provisional Application No. 61/442,073, filed on Feb. 11, 2011, entitled "Marine Riser Tensioner," which application is hereby incorporated herein by reference.

BACKGROUND OF THE INVENTION

1. Field of the Invention

The present invention relates in general to marine riser tensioners and, in particular, to a RAM style push up tensioner that accommodates riser tilt.

2. Brief Description of Related Art

Offshore production platforms must support production risers from oil or gas wells that extend to the platform from subsea wells. For platforms that are fixed to the ocean floor this is readily accomplished and is well known in the art. However, for subsea completions in deep water that require the use of floating platforms, such as tension leg platforms (TLPs) or semi-submersible platforms, supporting risers presents significant problems. These platforms move under the influence of waves, wind, and current and are subjected to various forces. Thus, the riser tensioning mechanism must permit the platform to move relative to the riser.

The riser tensioning mechanism must also maintain the riser in tension so that the entire weight of the riser is not transferred to the wellhead and so that the riser does not collapse under its own weight. The tensioning mechanism must therefore exert a continuous tensional force on the riser. Also, this force must be maintained within a narrow tolerance.

Push up tensioners have several advantages in subsea applications, one being that the tensioner accommodates higher loads in a smaller space over other types of tensioners. This is in part because push up tensioners use a more efficient piston end and do not require a tension pulling device at the end connection. In addition, the pressure in push up tensioners does not act on the rod side of the cylinder. Where seas are rough, and the floating platform experiences great range of vertical motion, push up tensioners are better able to accommodate that vertical motion. In addition, use of a push-up tensioner can minimize the corrosive effects of the salt-water environment in which they must operate because the high pressure seals of the tensioner are not located adjacent to the atmosphere and are isolated from caustic fluids and debris.

TLPs provide stable drilling platforms in deeper waters. In TLPs, tension legs extends from the platform down to an anchor located at the sea floor. The tension legs are relatively inelastic meaning that much of the vertical motion of the platform is eliminated. TLPs allow for location of the wellhead assembly on the surface rather than on the sea floor. A riser will typically extend from the wellhead assembly down to the sea floor. This setup allows for simpler well completion and better control of production. However, in TLPs the riser may tilt from the vertical relative to the TLP. The amount of riser tilt from the vertical is not static and varies with time during operation.

While use of both TLPs and RAM type push up tensioners is desired, because of the varying riser tilt, RAM style push-up tensioners constructed to date are not currently suitable for use with TLPs. In all previous RAM systems, the cylinders remain in line with the riser, which allows for small spacing of the risers. While the small size of the RAM style push up tensioner is desirable, the small size also causes a problem in that it limits the size of the passage in which the riser may be run. Therefore, there is a need for a push up riser tensioner that can tilt with the riser and allow suitable space for running of a riser for use in a TLP.

SUMMARY OF THE INVENTION

These and other problems are generally solved or circumvented, and technical advantages are generally achieved, by preferred embodiments of the present invention that provide a marine riser tensioner, and a method for using the same.

In accordance with an embodiment of the present invention, a tensioner for maintaining a tensile force in a riser having an axis is disclosed. The riser extends from a subsea wellhead assembly through an opening in a floating platform deck. The tensioner comprises a tensioner ring coupled to the riser, and a plurality of hydro-pneumatic cylinders. Each hydro-pneumatic cylinder has flexible joints on opposite ends for coupling the cylinder between the deck and the tensioner ring. The plurality of hydro-pneumatic cylinders are moveable by remote actuation in at least one plane between a running position and a tensioning position. The cylinders are adapted to automatically couple to the tensioner ring after moving from the running position to the tensioning position.

In accordance with another embodiment of the present invention, a tensioner for maintaining a tensile force in a riser having an axis is disclosed. The riser extends from a subsea wellhead assembly through an opening in a floating platform deck. The tensioner comprises a tensioner ring for coupling to the riser, and a plurality of hydro-pneumatic cylinders. The hydro-pneumatic cylinders extend between the deck and the tensioner ring. The tensioner also includes guide roller assembly that is adapted to mount to the deck and roll along the riser. A conductor sleeve extends from the tensioner ring parallel to the riser and is adapted to interface with rollers of the guide roller assembly. When the riser rotates relative to the deck, the conductor sleeve will resist rotation of the tensioner through react forces exerted by the guide roller assembly while allowing for rotation of the riser relative to the tensioner ring.

In accordance with yet another embodiment of the present invention, a method for tensioning a riser passing through an opening in a deck of a platform is disclosed. The method comprises placing a plurality of hydro-pneumatic cylinders around the opening in the deck. The cylinders are then flexibly connected at a first end to the deck. The method then moves the cylinders from a running position perpendicular to the deck to a tensioning position at an angle to the deck. After movement of the cylinders to the tensioning position, the method automatically couples a second end of each cylinder to a tensioner ring coupled to the riser. As the riser tilts relative to the platform, the method allows the cylinders to move in more than one plane to accommodate for the riser tilt.

An advantage of a preferred embodiment is that a push up tensioner may accommodate varying tilt of a riser extending from a subsea environment to a tension leg platform (TLP). The disclosed embodiments allow for the maximum space to be used to run the riser, while still fitting into a smaller footprint compared to other conventional tensioners. Still further, the disclosed embodiments accommodate a greater range of vertical motion between the riser and the TLP. The disclosed embodiments also allow for larger tensioner loads and reduced corrosion issues while allowing push up tensioners to be used with TLPs.

BRIEF DESCRIPTION OF THE DRAWINGS

So that the manner in which the features, advantages and objects of the invention, as well as others which will become apparent, are attained, and can be understood in more detail, more particular description of the invention briefly summarized above may be had by reference to the embodiments thereof which are illustrated in the appended drawings that form a part of this specification. It is to be noted, however, that the drawings illustrate only a preferred embodiment of the invention and are therefore not to be considered limiting of its scope as the invention may admit to other equally effective embodiments.

DETAILED DESCRIPTION OF THE PREFERRED EMBODIMENT

The present invention will now be described more fully hereinafter with reference to the accompanying drawings which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout, and the prime notation, if used, indicates similar elements in alternative embodiments.

In the following discussion, numerous specific details are set forth to provide a thorough understanding of the present invention. However, it will be obvious to those skilled in the art that the present invention may be practiced without such specific details. Additionally, for the most part, details concerning well drilling, running operations, and the like have been omitted in as much as such details are not considered necessary to obtain a complete understanding of the present invention, and are considered to be within the skills of persons skilled in the relevant art.

Figure 1:
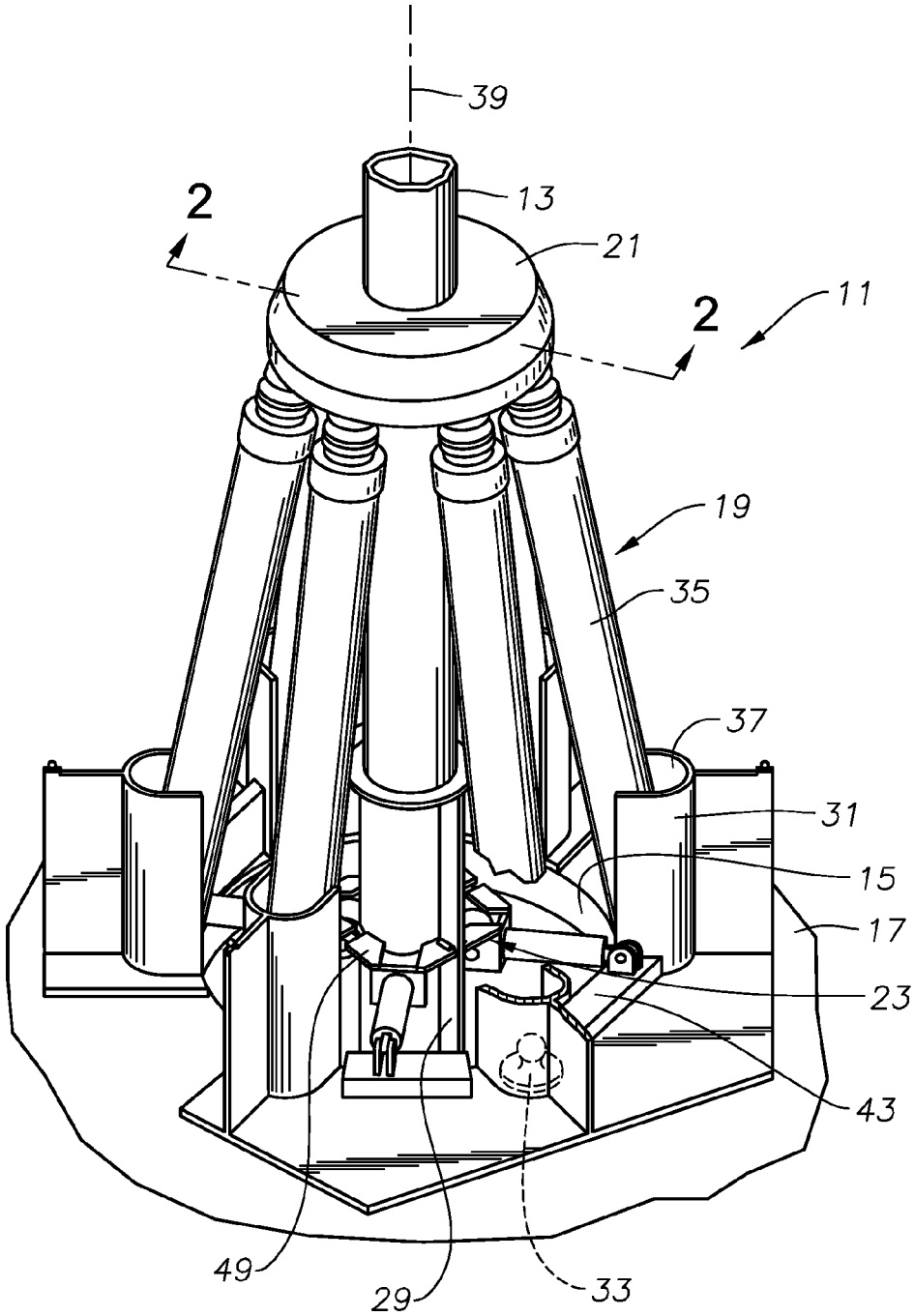
FIG. 1 is a perspective view of a riser tensioner assembly in accordance with an embodiment of the present invention.
Figure 2:
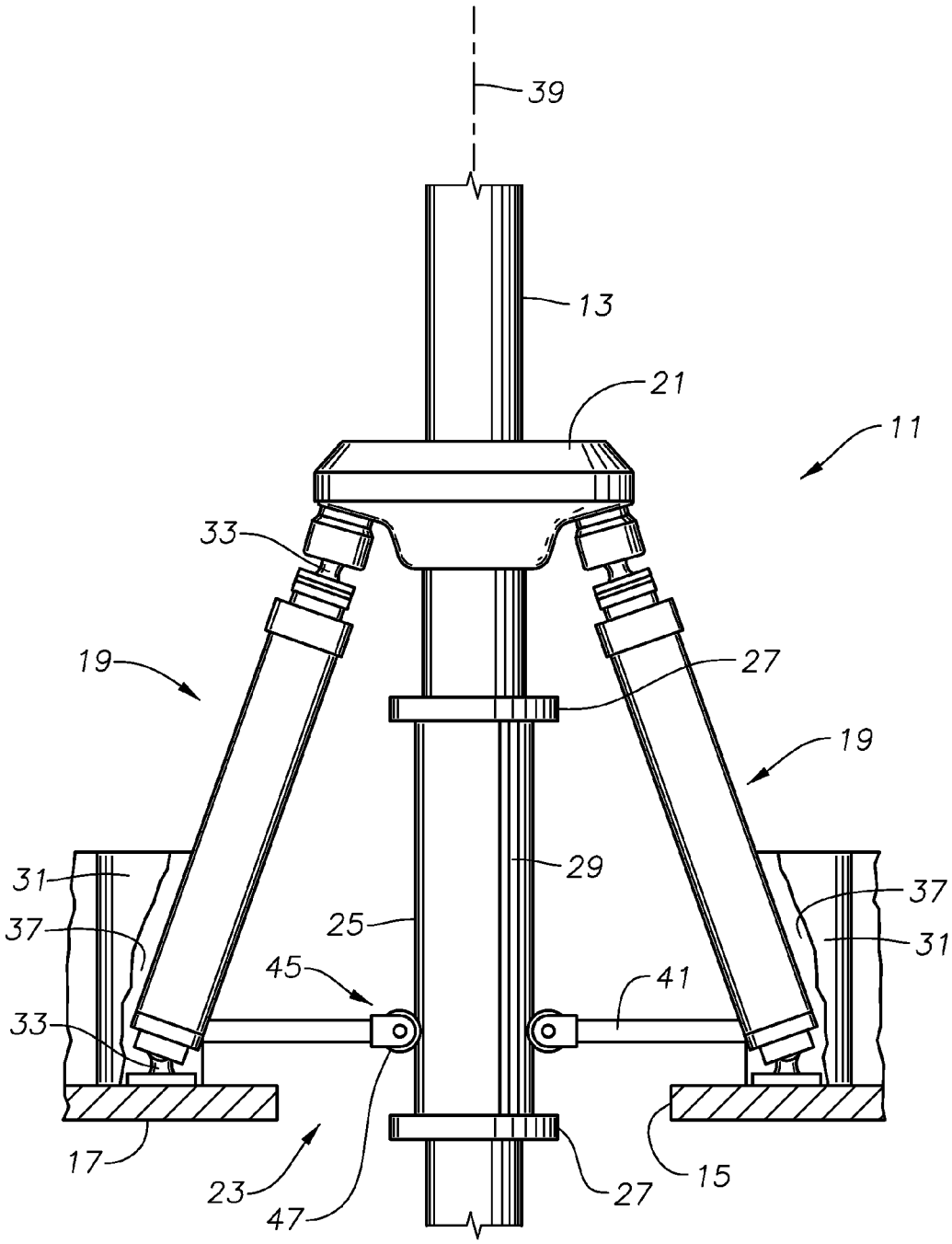
FIG. 2 is a sectional view of the riser tensioner assembly of FIG. 1 taken along line 2-2.
Figure 7:
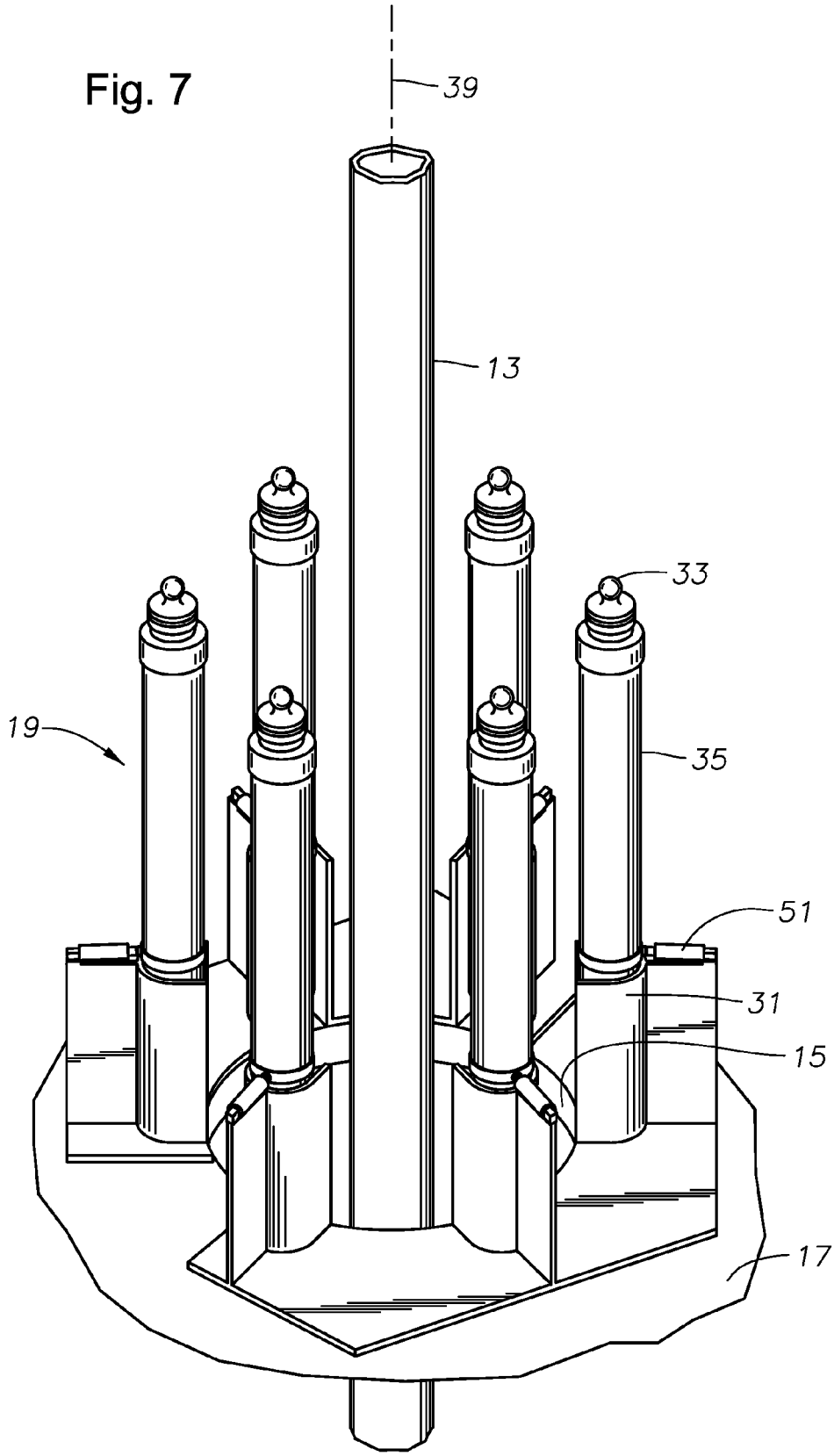
FIGS. 7, 8A, and 9 schematically illustrate movement of the cylinders of FIG. 1 from a running position to a tensioning position.

Referring to FIG. 1 and FIG. 2, a riser tensioner assembly 11 provides tension to a riser 13 that has its lower end secured to subsea equipment such as a subsea wellhead assembly (not shown). Riser tensioner assembly 11 has a tensioning position, shown in FIGS. 1-4, 8A, and 9-14, and a running position, shown in FIGS. 5, and 7. In the running position, cylinder assemblies 19 are decoupled from tensioner ring 21 and placed in a vertical position perpendicular to a deck 17 as shown in FIG. 5 and FIG. 7 and described in more detail below. In this manner, riser tensioner assembly 11 is cleared from an opening 15 in deck 17, allowing the maximum amount of space for running of riser 13 and equipment coupled to the riser.

Riser 13 extends upward through opening 15 in deck 17 of a vessel (not shown). Although moored, typically deck 17, i.e. the vessel, will move relative to riser 13 in response to current and wave motion. A plurality of cylinder assemblies 19 are supplied with hydraulic fluid and gas under pressure to provide an upward force to riser 13 to maintain a uniform tension in riser 13 as deck 17 moves relative to riser 13. Six cylinder assemblies 19 are shown herein for ease of explanation. A person skilled in the art will understand that more or fewer cylinder assemblies 19 may be used.

A lower end of each cylinder assembly 19 couples to deck 17 and an upper end removably couples to a tensioner ring 21. Tensioner ring 21 is an annular disc like object that may clamp to riser 13 such that tensioner ring 21 is coaxial with an axis 39 passing through riser 13. Tensioner ring 21 may also thread onto riser 13 or a riser tensioner joint as described in more detail below. A person skilled in the art will understand that riser 13 may refer to the riser extending between the wellhead and the drilling rig or a riser tensioner joint coupled inline to riser 13 proximate to riser tensioner assembly 11.

The lower ends of each cylinder assembly 19 are placed circumferentially around opening 15. In the illustrated embodiment, the lower ends of each cylinder are coupled at an edge of opening 15, such that the diameter of a circle having an edge passing through each lower end coupling location of each cylinder assembly 19 will be larger than the diameter of tensioner ring 21. In this manner, riser tensioner assembly 11 will not topple at the expected maximum tilt of riser 13. A person skilled in the art will understand that the lower end of each cylinder assembly 19 may couple to deck 17 a greater distance from opening 15 as needed such that the lower ends of cylinder assemblies 19 will not couple to deck 17 directly beneath tensioner ring 21 when riser 13 is in an un-tilted state. In addition, riser tensioner assembly 11 may include an anti-shift assembly or guide assembly 23 employed to guide or centralize riser 13 in opening 15. Guide assembly 23 is mounted around riser 13 while in the tensioning position for engagement with riser 13, or a component mounted to riser 13.

Each cylinder assembly 19 includes a coupler 33 on each end of a cylinder 35. Each cylinder 35 has a barrel and a rod, allowing each cylinder 35 to move between a contracted position shown in FIG. 8A, and an extended position shown in FIG. 9. In the extended position, the upper end of each cylinder 35 moves further from the respective lower end of each cylinder 35, and in the contracted position, the upper end of each cylinder 35 moves closer to the respective lower end of each cylinder 35. The lower end of each cylinder 35 pivotally couples to deck 17 with coupler 33, such as the shown ball and socket joint. In the exemplary embodiment, cylinder 35 may pivot about the lower coupler 33. Similarly, each cylinder 35 couples to tensioner ring 21 with coupler 33, such as the illustrated ball and socket joint. As with the lower coupler 33, upper coupler 33 permits cylinder 35 to pivot about upper coupler 33. Cylinder 35 may pivot about each coupler 33 in one or more planes. For example, cylinder 35 may pivot in three dimensions defined by three perpendicular axes having an origin at each coupler 33. In this manner, cylinder 35 may pivot in one or more planes, and preferably in unlimited planes, as deck 17 moves relative to riser 13.

Figure 10:
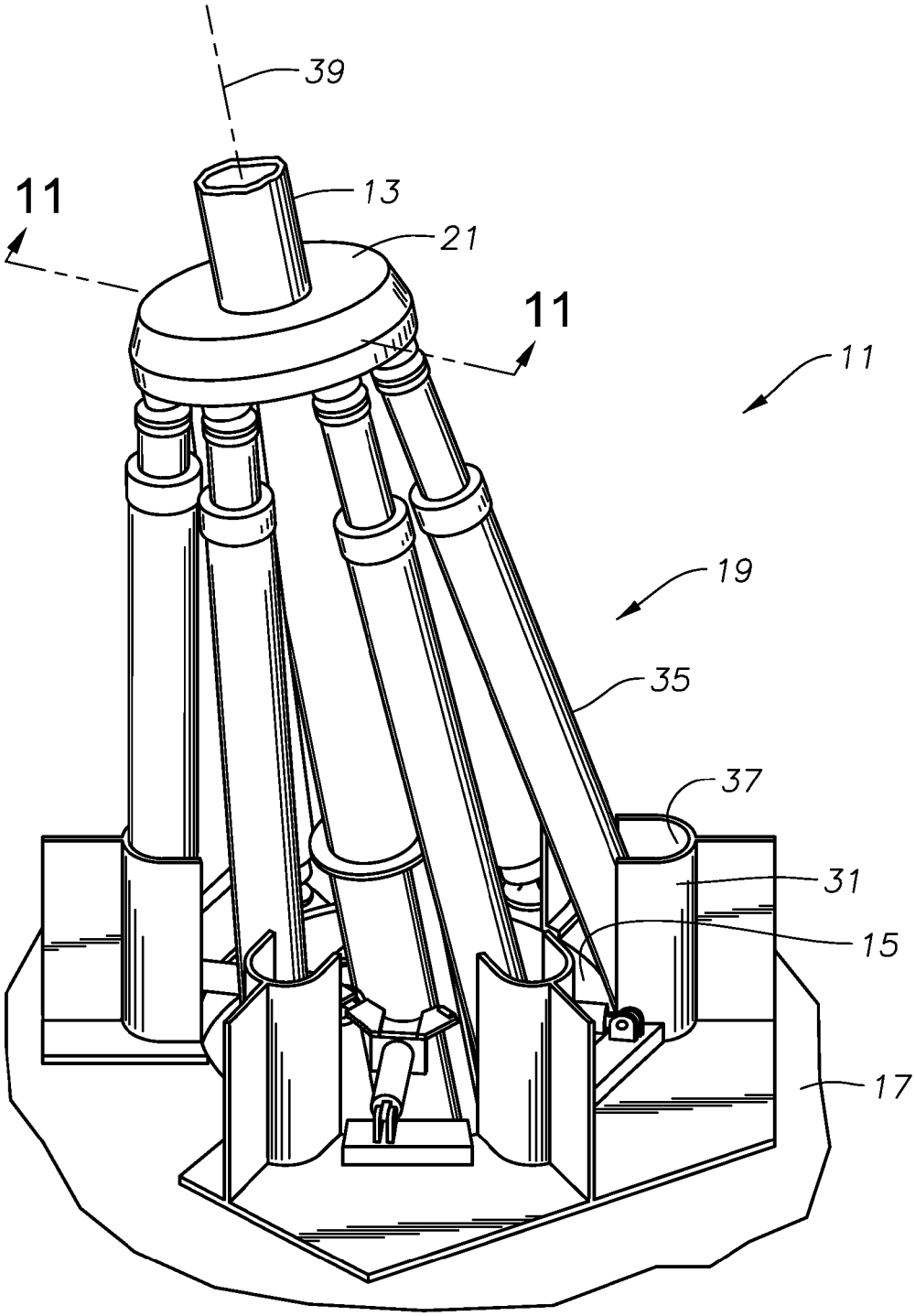
FIG. 10 illustrates the riser tensioner assembly of FIG. 1 accommodating riser tilt in accordance with an embodiment of the present invention.
Figure 11:
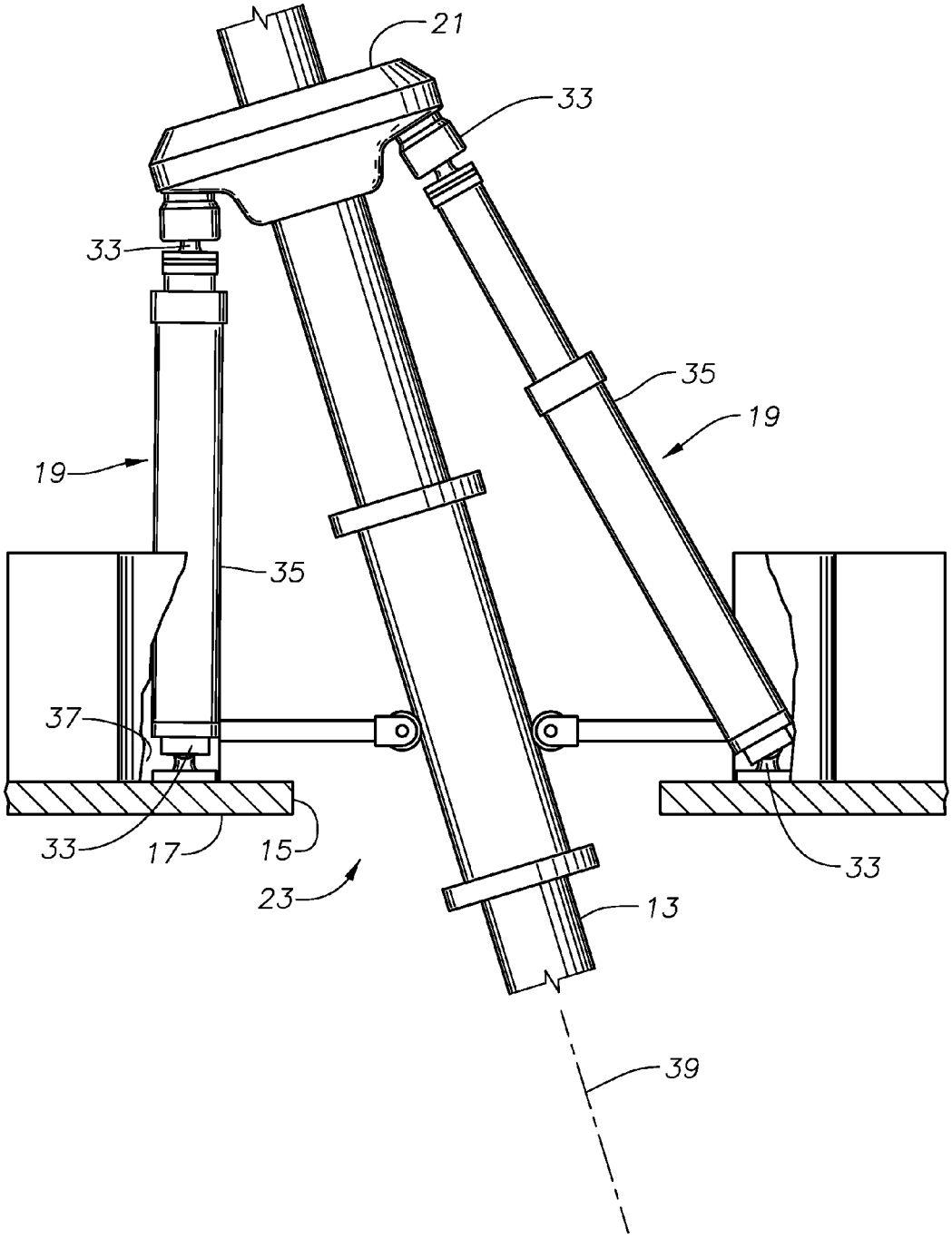
FIG. 11 is a sectional view of the riser tensioner assembly of FIG. 10 taken along line 11-11.

Pivoting at couplers 33 will occur as deck 17 and riser 13 move relative to one another. Thus, as riser 13 tilts away from the vertical in relation to deck 17, tensioner ring 21 will move from the position illustrated in FIG. 1. In an exemplary embodiment, riser 13 and tensioner ring 21 may variably occupy the position shown in FIGS. 10 and 11. As illustrated in FIGS. 10 and 11, cylinders 35 will pivot at the upper and lower couplers 33 to maintain connection to both deck 17 and tensioner ring 21. Each cylinder will extend, contract, and pivot as needed to remain coupled with tensioner ring 21 and deck 17. Similarly, as riser 13 tilts, each cylinder will contract, expand and pivot as necessary to exert a tensioning force on riser 13.

As illustrated in FIG. 1, each cylinder assembly 19 also includes a mechanical stop 31 that mounts to deck 17 adjacent to each cylinder 35. Each mechanical stop 31 extends vertically from deck 17 and defines a partial cylindrical receptacle 37 facing opening 15 in deck 17. Receptacle 37 extends the length of mechanical stop 31 and is of a size and shape to receive cylinder 35 when cylinder 35 pivots to a position that is perpendicular to deck 17 as shown in FIGS. 5 and 7. When cylinder 35 is in the perpendicular position, a surface of cylinder 35 will abut receptacle 37. In the event that tilt of riser 13 attempts to push cylinder 35 past the perpendicular position away from opening 15 and toward a surface of deck 17, mechanical stop 31 will exert a reactive force against cylinder 35, maintaining cylinder 35 in the perpendicular position.

Figure 3:
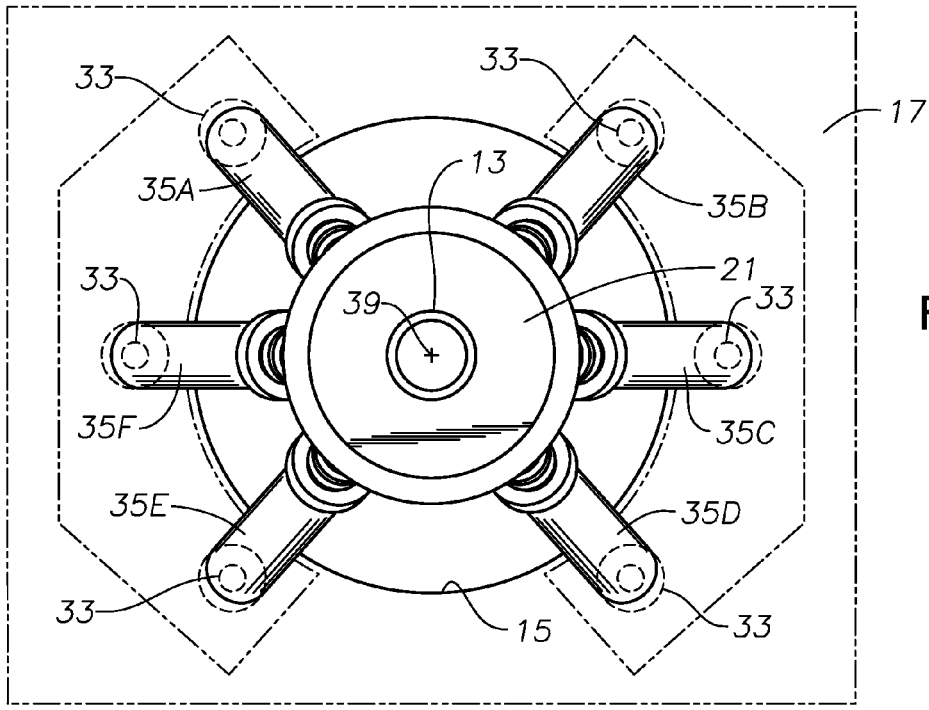
FIG. 3 is a top view of the riser tensioner assembly of FIG. 1 illustrating cylinder alignment of the riser tensioner assembly of FIG. 1.

The exemplary embodiment of riser tensioner assembly 11 illustrated in FIG. 3 shows the alignment of cylinders 35 of cylinder assemblies 19 around opening 15. As shown in FIG. 3, the six cylinders 35 of the exemplary embodiment are arranged around opening 15 such that a vertical plane will pass through both ends of each cylinder at upper and lower couplers 33, and axis 39. For example, a vertical plane passing through upper and lower ends of cylinder 35A at couplers 33 will include axis 39. Similarly, separate vertical planes passing through upper and lower ends of each cylinder 35B, 35C, 35D, 35E, 35F at couplers 33, respectively, will include axis 39.

Figure 4:
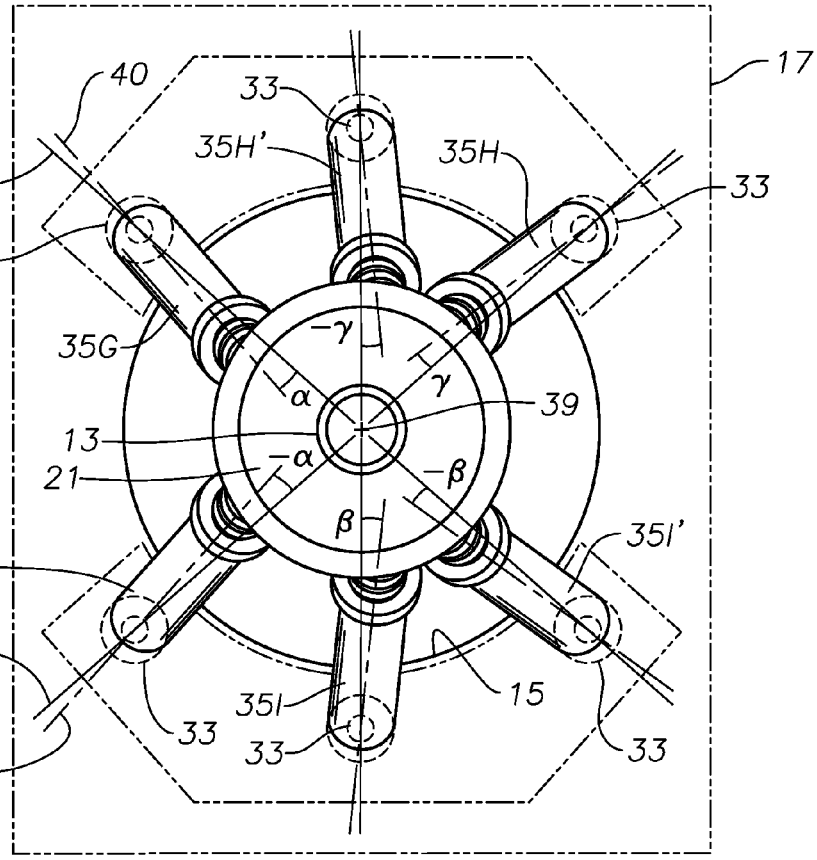
FIG. 4 is a top view of an alternative embodiment of the riser tensioner assembly of FIG. 1 illustrating an alternative cylinder alignment of the riser tensioner assembly of FIG. 1.
Figure 5:
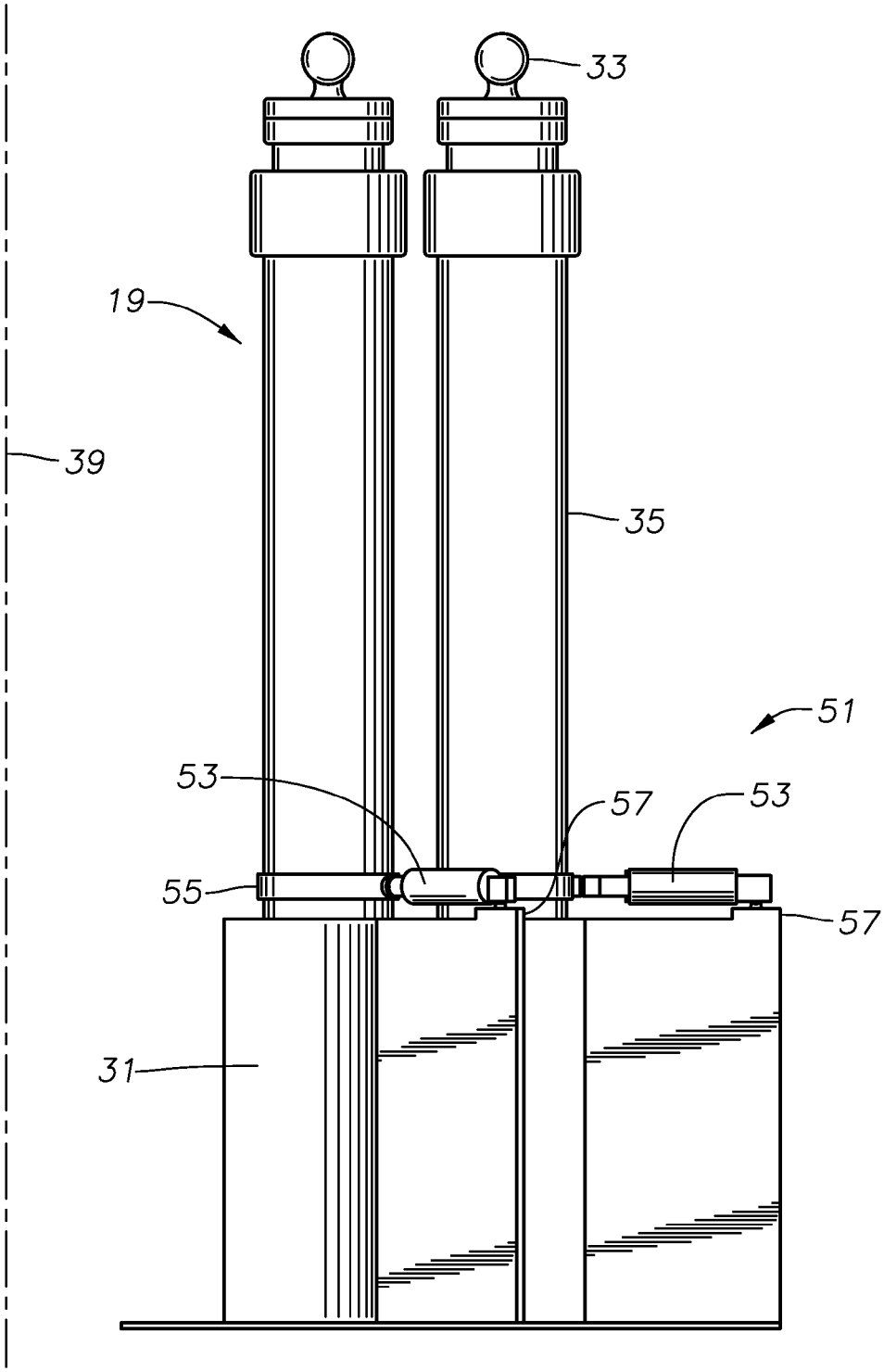
FIG. 5 is a partial view of a cylinder assembly of FIG. 1 in a first position.

In an alternative embodiment, illustrated in FIG. 4, cylinders 35 comprise three cylinder pairs 35G and 35G', 35H and 35H', and 35I and 35I'. In this embodiment, a vertical plane passing through the ends of each individual cylinder at couplers 33 will not include axis 39. Instead, the upper couplers 33 of each cylinder will be offset from the position described in FIG. 3, with the upper coupler 33 of each cylinder pair offset by an equivalent amount in opposite directions. For example, the lower couplers 33 are mounted around opening 15 as described above with respect to FIG. 3. However, in FIG. 4, the upper couplers 33 of each cylinder 35 are not mounted around tensioner ring 21 in a vertical plane passing through axis 39 and the lower couplers 33. As shown in FIG. 4, a vertical plane 42 passes through the lower coupler 33 of cylinder 35G and axis 39. Another vertical plane 40 passes through the lower coupler 33 of cylinder 35G and the upper coupler 33 of cylinder 35G. Plane 42 and plane 40 form angle $\alpha$ at lower coupler 33 of cylinder 35G. The paired cylinder 35G' will be offset in a similar manner in the opposite direction. For example, a vertical plane 44 passes through the lower coupler 33 of cylinder 35G' and axis 39. Another vertical plane 46 passes through the lower coupler 33 of cylinder 35G' and the upper coupler of cylinder 35G'. Plane 44 and plane 46 will form angle $-\alpha$ at lower coupler 33 of cylinder 35G'. In a similar manner, the upper coupler 33 of cylinder 35H will be offset at an angle $\gamma$, and the upper coupler 33 of cylinder 35H' will be offset at an angle $-\gamma$. The upper coupler 33 of cylinder 35I will be offset at an angle $\beta$, and the upper coupler of cylinder 35I' will be offset at an angle $-\beta$.

By offsetting each cylinder in the pair in opposite directions, as illustrated in the embodiment of FIG. 4, additional torsional stability is achieved. Thus, if the vessel rotates about riser 13, while one cylinder of the pair may enhance rotation, the opposite cylinder in the pair will react to reduce rotation. For example, if deck 17 rotates clockwise relative to riser 13 from the position shown in FIG. 4, the force exerted on tensioner ring 21 and riser 13 by cylinder 35H' will accelerate the rotation; however, because cylinder 35H is offset an equal amount in the opposite direction from cylinder 35H', the force exerted on tensioner ring 21 and riser 13 by cylinder 35H will counteract the rotation accelerated by cylinder 35H'. The similar is true for cylinder pairs 35G and 35G', and 35I and 35I'.

Figure 6:
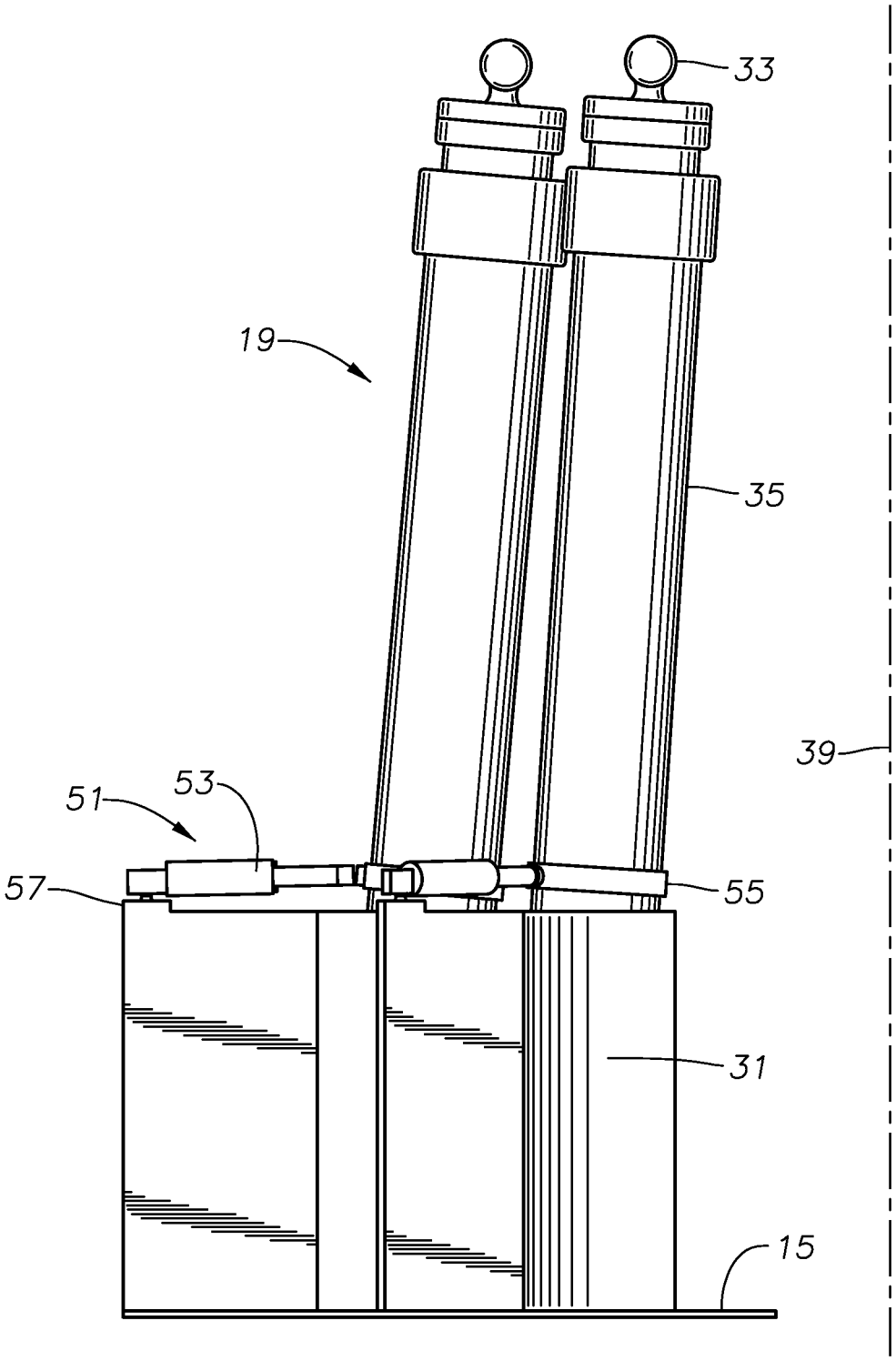
FIG. 6 is a partial view of the cylinder assembly of FIG. 5 in a second position.
Figure 8A:
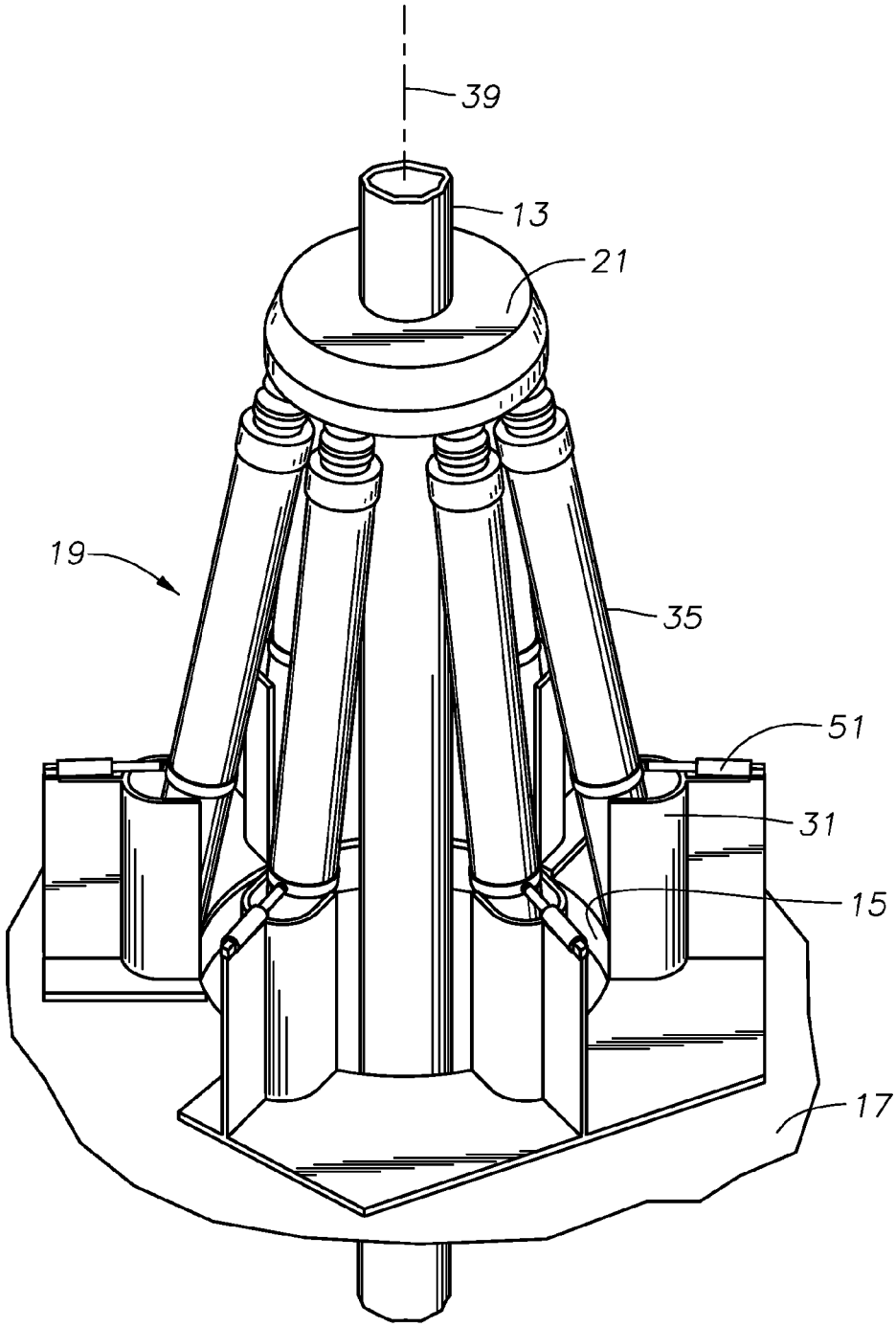

As shown in FIG. 5 and FIG. 6, cylinder assembly 19 includes a placement assembly 51. In the illustrated embodiment, placement assembly 51 includes a placement cylinder 53, a cylinder coupler 55, and a rigid coupler 57. Rigid coupler 57 couples to an upper end of mechanical stop 31 and provides a mounting point for a first end of placement cylinder 53. Rigid coupler 57 may comprise a pin mounting, a bolted bracket assembly or any other suitable coupling device. Rigid coupler 57 is located a sufficient distance from receptacle 37 such that when cylinder 35 is perpendicular to deck 17, a surface of cylinder 35 may contact a surface of receptacle 37 and allow placement cylinder 53 to remain coupled to cylinder 35 while in the running position. A second end of placement cylinder 53 couples to cylinder coupler 55. Cylinder coupler 55 couples to cylinder 35 such that placement cylinder 53 will exert a force on cylinder 35. Placement cylinder 53 actuates to move cylinder 35 from the running position perpendicular to deck 17, shown in FIG. 5, to the tensioning position angled inboard toward opening 15, shown in FIG. 6. After placing cylinders 35 in the tensioning position, placement cylinders 53 do not operate further. In an exemplary embodiment, after placement of cylinders 35 in the tensioning position of FIG. 6 and coupling of tensioner ring 21 to cylinders 35, as shown in FIG. 8A and described below, placement cylinders 35 may be decoupled from cylinders 35.

Once running of riser 13 is complete, cylinder assemblies 19 are tilted to the tensioning position shown in FIGS. 1-4, 6, and 8-11, by placement cylinders 53. In the exemplary embodiment, placement cylinders 53 are hydraulic cylinders that may be actuated by an operator to move cylinders 35 from the running position to the tensioning position. Preferably, the actuation process is remotely operated by any suitable controlling mechanism, such as a hydraulic pressure system, electronic controls system, or the like. A person skilled in the art will understand that the illustrated placement assembly 51 is but an example of a mechanism to move cylinders 35 from the running position of FIG. 5 to the tensioning position of FIG. 6. Alternative assemblies may include H-frame assemblies, screw assemblies, or the like adapted to operate as described above with respect to the hydraulic cylinder placement assembly 51. These additional embodiments are contemplated and included by the disclosed embodiments.

Tensioner ring 21 may clamp to riser 13 proximate to riser tensioner assembly 11 and be run on riser 13 proximate to riser tensioner assembly 11. Cylinders 35 of cylinder assemblies 19 then pivot toward riser 13, as shown in FIG. 6, and couple to tensioner ring 21, as shown in FIG. 8A. Coupling of cylinders 35 of cylinder assemblies 19 to tensioner ring 21 will occur in an automatic fashion such that as tensioner ring 21 descends on riser 13 following placement of cylinders 35 in the tensioning position of FIG. 6 by placement assemblies 51, couplers 33 at the upper ends of cylinders 35 will automatically engage coupler receptacles on an underside of tensioner ring 21.

Figure 8C:
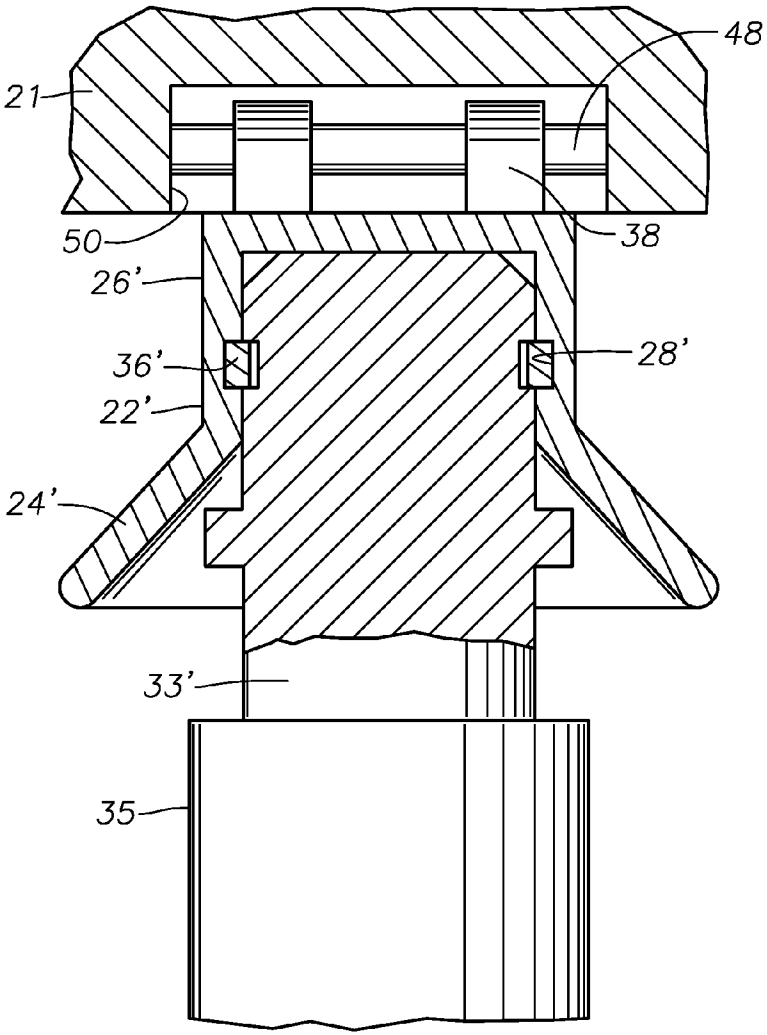
FIGS. 8B-8E schematically illustrate alternative embodiments of an automatic coupling apparatus for coupling the cylinders of FIG. 1 to a tensioner ring of FIG. 1.
Figure 8B:
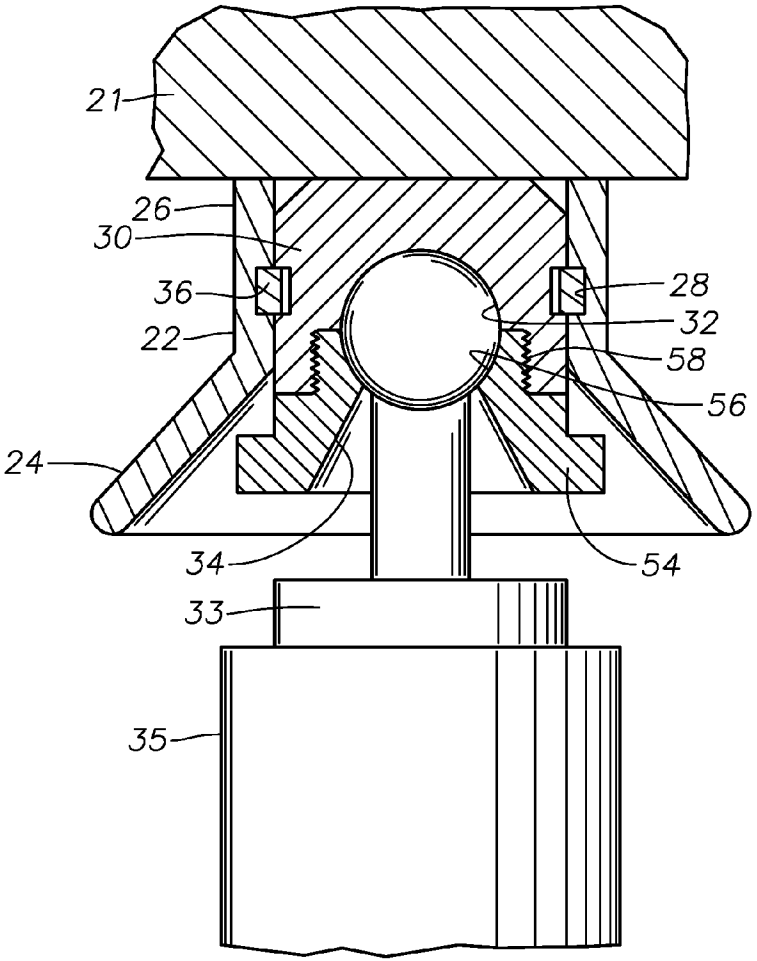

One manner in which cylinders 35 may couple to tensioner ring 21 is illustrated in FIG. 8B. Tensioner ring 21 may include a plurality of guidance receptacles 22, one guidance receptacle 22 corresponding to each cylinder 35. Guidance receptacles 22 have a conical lower end 24 transitioning from a larger diameter end to a diameter of a cylindrical tube 26 where guidance receptacles 22 join the lower portion of tensioner ring 21. Cylindrical tube 26 defines an annular lock channel 28 in an interior diameter surface of cylindrical tube 26. Coupler 33 includes a ball seat 30 defining an upper semi-spherical cavity 32. Coupler 33 also includes a ball retainer 54 defining a lower semi-spherical cavity 56. Ball retainer 54 has a conical opening 34 at a lower end of ball retainer 54. Cavity 32 and cavity 56 define a spherical cavity of a diameter substantially equal to the diameter of a ball of coupler 33, as illustrated, having an opening across a lower portion of cavity 56 such that the opening has a narrower diameter than cavities 32, 56. Conical opening 34 transitions from a diameter at a lower surface of ball retainer 54 to the narrower diameter of the opening of cavity 56. After the ball end of coupler 33 is inserted into cavity 32, ball retainer 54 will be secured to ball seat 30 through matching threads 58. Coupler 33 may rotate on the ball through the range of motion allowed by conical opening 34 in ball retainer 54. In the illustrated embodiment, the ball of coupler 33 will be inserted into ball seat 30 prior to placement of cylinder 35 into the tensioning position of FIG. 6, and preferably during assembly of riser tensioner 11. A lock ring 36 is coupled around an exterior diameter portion of ball seat 30 and is adapted to insert into lock channel 28 when ball seat 30 is moved into cylindrical tube 26, thereby coupling cylinder 35 to tensioner ring 21.

A person skilled in the art will understand that this may be accomplished without manual input from an operator as tensioner ring 21 descends on riser 13 proximate to cylinders 35. After movement of cylinders 35 by placement assemblies 51 to the tensioning position of FIG. 6, ball seat 30 will be proximate to conical lower end 24 of guidance receptacle 22. As tensioner ring 21 moves axially downward toward cylinders 35, ball seat 30 will contact and slide along the interior surface of conical lower end 24 until reaching cylindrical tube 26. There, ball seat 30 will land and substantially fill cylindrical tube 26, causing lock ring 36 to insert into lock channel 28, securing cylinder 35 to tensioner ring 21 while allowing cylinder 35 to pivot about coupler 33. A person skilled in the art will understand that each cylinder may variably extend or contract as needed to insert into guidance receptacle 22.

In an alternative embodiment, shown in FIG. 8C, coupler 33' comprises a cylindrical upper end of cylinder 35. Guidance receptacle 22' is similar to and includes the components of guidance coupler 22 of FIG. 8B. As shown in FIG. 8C, guidance coupler 22' includes a clevis hanger 38 mounted on an upper portion of cylindrical tube 26'. Tensioner ring 21 defines a recess 50 extending from the lower surface of tensioner ring 21 inward a sufficient distance to accommodate clevis hanger 38 and a pin 48. Pin 48 passes through clevis hanger 38 and is secured at either end within recess 50 to tensioner ring 21 such that a load may transfer between guidance receptacle 22' and tensioner ring 21 through clevis 38 and pin 48.

Similar to that described above with respect to FIG. 8B, after movement of cylinders 35 by placement assemblies 51 to the tensioning position of FIG. 6, coupler 33' will be proximate to conical lower end 24' of guidance receptacle 22'. As tensioner ring 21 moves axially downward toward cylinders 35, coupler 33' will contact and slide along the interior surface of conical lower end 24' until reaching cylindrical tube 26'. There, coupler 33' will land and substantially fill cylindrical tube 26', causing lock ring 36' to insert into lock channel 28', securing cylinder 35 to tensioner ring 21 while allowing cylinder 35 to pivot about coupler 33' on clevis 38 and pin 48.

A person skilled in the art will understand that the apparatus described above with respect to FIGS. 8B and 8C are but examples of a mechanism to secure cylinders 35 to tensioner ring 21 without direct manual manipulation from an operator. A person skilled in the art will understand that any suitable means for securing cylinders 35 to tensioner ring 21 after placement of cylinders 35 in the tensioning position is contemplated and included in the disclosed embodiments. Preferably, the securing mechanism will be free of direct manual manipulation from an operator although the securing mechanism may include remote operator manipulation.

Figure 8E:
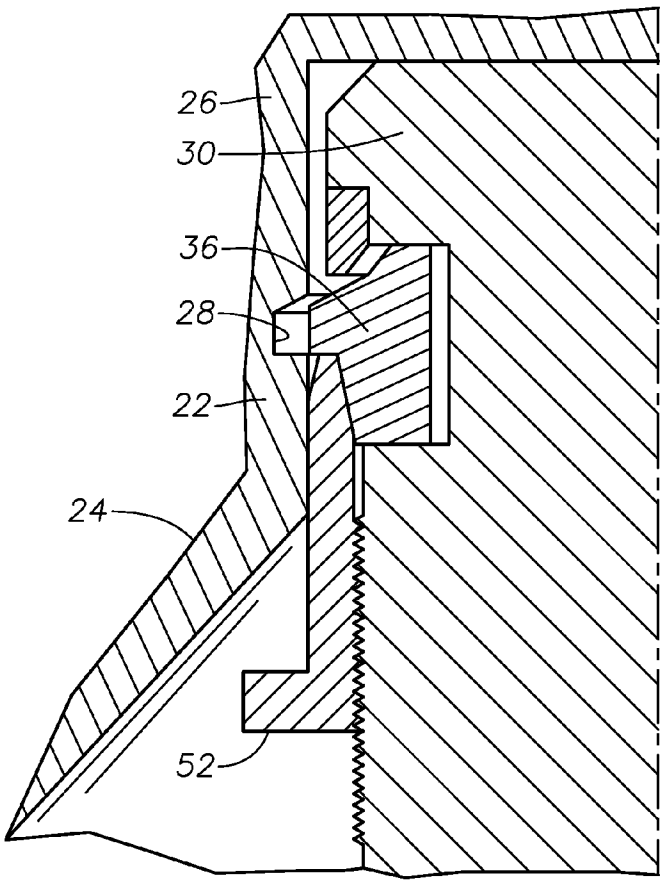
Figure 8D:
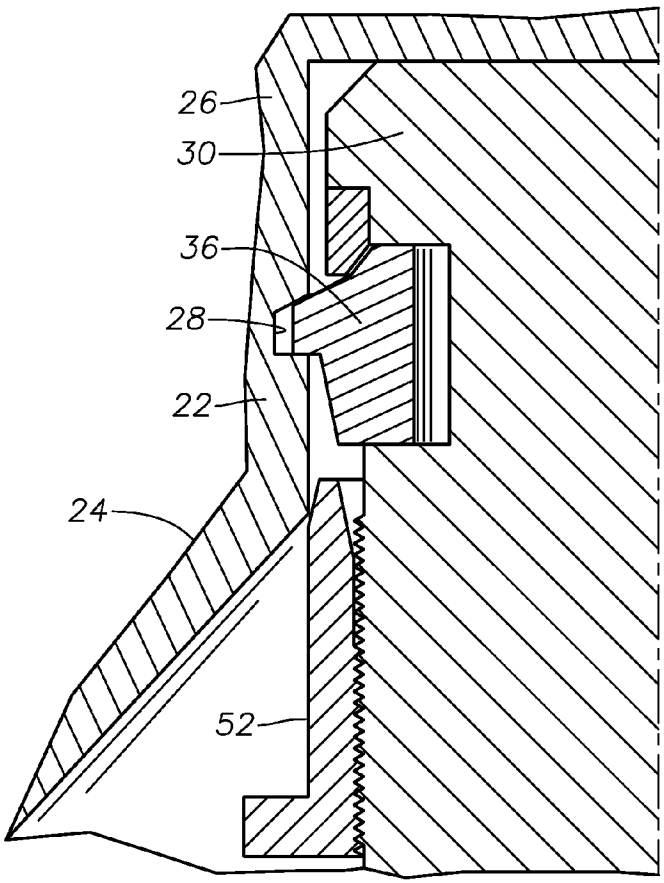

As shown in FIG. 8D, lock ring 36 and lock channel 28 may operate as described below. A retraction ring 52 may circumscribe ball seat 30. Retraction ring 52 will secure to ball seat 30 such that retraction ring 52 may move axially along the exterior surface of ball seat 30. Retraction ring 52 may move axially by rotating through threads on an interior diameter of retraction ring 52 that mate with corresponding threads on an exterior diameter of ball seat 30. Alternatively, retraction ring may slide axially through ratchet teeth, or may move axially in any other suitable manner. Retraction ring 52 may be optionally biased to a lower position shown in FIG. 8D. Lock ring 36 mounts to ball seat 30 within an annular channel axially above retraction ring 52. A mounting ring may secure to an outer portion of ball seat 30 and extend into the channel of ball seat 30 to prevent lock ring 36 from moving radially completely out of the channel in ball seat 30. Preferably, lock ring 36 is biased to an engaged position illustrated in FIG. 8D. In the illustrated embodiment, lock ring 36 is a split ring adapted to be biased to the engaged position. A person skilled in the art will understand that other suitable biasing methods are contemplated and include in the disclosed embodiments.

As shown in FIG. 8D, the exterior diameter of lock ring 52 has a profile adapted to engage a mating profile of lock channel 28. The mating profiles are adapted to allow lock ring 36 to move axially upward from an area below lock channel 28 to an area above lock channel 28 when lock ring 36 is in the engaged position of FIG. 8D, while engaging to prevent lock ring 36 from moving from the area above lock channel 28 to the area below lock channel 28 when lock ring 36 is in the engaged position illustrated in FIG. 8D. When ball seat 30 inserts into guidance receptacle 22, lock ring 36 will slip past the mating profile of lock channel 28 and then engage the mating profile of lock channel 28 to secure cylinder 35 to tensioner ring 21. A person skilled in the art will understand that the illustrated example is but one mechanism for securing cylinder 35 to tensioner ring 21. Any suitable method that secures cylinder 35 to tensioner ring 21 without direct manual manipulation is contemplated and included in the disclosed embodiments.

As illustrated in FIG. 8E, cylinder 35 may be released by moving retraction ring 52 upwards axially relative to ball seat 30. This may be accomplished by rotating retraction ring 52 around ball seat 30 through the illustrated threads. This will cause an end of retraction ring 52 to engage a tapered edge of lock ring 36. Continued upward movement of retraction ring 52 will cause the engaged surfaces to slide past one another and move lock ring 36 radially inward into the channel of ball seat 30. In this manner, tensioner ring 21 may be released from cylinder 35 for further operations. A person skilled in the art will understand that the illustrated embodiment is but one example of a mechanism for releasing cylinder 35 from the coupling with tensioner ring 21. Any suitable method that releases cylinder 35 from tensioner ring 21 is contemplated and included in the disclosed embodiments. Preferably, the mechanism will include direct manual manipulation of the release mechanism through direct operator contact or operator manipulation of a manual tool.

Referring again to FIGS. 1-2, guide assembly 23 includes a cylindrical sleeve 25 mounted around riser 13. Sleeve 25 is rigidly attached to and surrounds an outer surface of the riser 13 so that sleeve 25 will not move axially or rotationally relative to riser 13 and thus may be considered as part of riser 13. Sleeve 25 has a length greater than the maximum stroke of cylinder assemblies 19 from the contracted to the extended positions of each cylinder 35 so that rollers 47, described in more detail below, remain in engagement with sleeve 25.

Sleeve 25 may have a flange 27 at its upper and lower ends that extends radially outward. An axially extending key or rib 29 is mounted on the exterior of sleeve 25 and extends from the lower flange 27 (FIG. 2) to the upper flange 27. Rib 29 may be attached either by welding or fasteners. Rib 29 may have a rectangular or other configuration in cross-section.

As shown in FIG. 1 and FIG. 2, the guide assembly 23 also includes rigid horizontal members 41, each having a first end that pivotally couples to deck 17. In an exemplary embodiment, rigid horizontal members 41 couple directly to deck 17 in any suitable manner. In an alternative embodiment, rigid horizontal members 41 may couple to a plate 43 (FIG. 1) coupled to mechanical stop 31. Plate 43 may include a separate object from mechanical stop 31 that is later welded or otherwise coupled to mechanical stop 31. Plate 43 may also be an integral component of mechanical stop 31 formed as a part of mechanical stop 31. In the illustrated embodiment, plate 43 extends from a vertical portion of mechanical stop 31 adjacent to opening 37. Plate 43 does not inhibit movement of cylinder 35 into abutment with receptacle 37. A person skilled in the art will understand that any suitable mechanism to mount rigid horizontal members 41 to deck 17 so that they may operate as described herein is contemplated and included in the disclosed embodiments.

A second end of rigid horizontal members 41 includes a roller assembly 45 aligned with sleeve 25. As shown in FIG. 2, roller assembly 45 includes roller 47. Roller 47, may optionally comprise two rollers as illustrated in FIGS. 12-14. As shown in FIG. 2, roller 47 engages the surface of sleeve 25 and allows sleeve 25 to move axially along axis 39; however, any attempted lateral shift in a radial direction from axis 39 is constrained by rigid horizontal members 41. Optionally, roller assembly 45 includes a rigid alignment assembly 49 (FIG. 1) that extends along the circumference of sleeve 25 and engages rib 29, thereby preventing rotation of sleeve 25 relative to guide assembly 23. While constraining rotation and radial or lateral shift, guide assembly 23 allows riser 13 to pivot about the ends of rigid horizontal members 41, thus allowing riser 13 to tilt relative to deck 17.

Figure 12A:
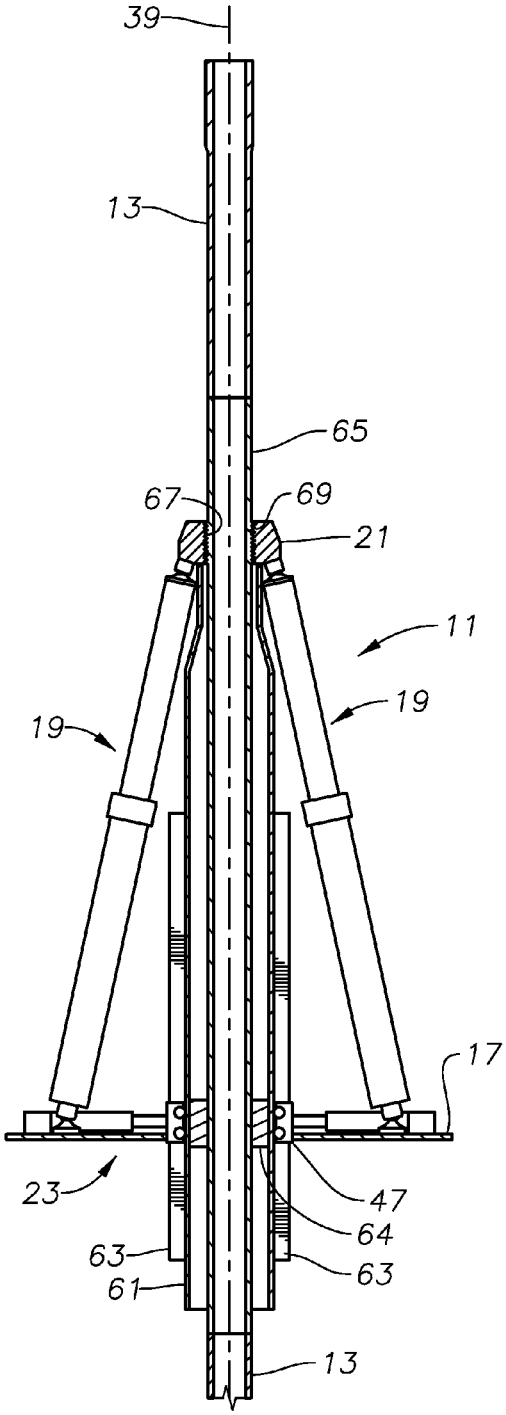
FIGS. 12A-12B are sectional side and top views, respectively, of an alternative embodiment of the riser tensioner assembly of FIG. 1.
Figure 12B:
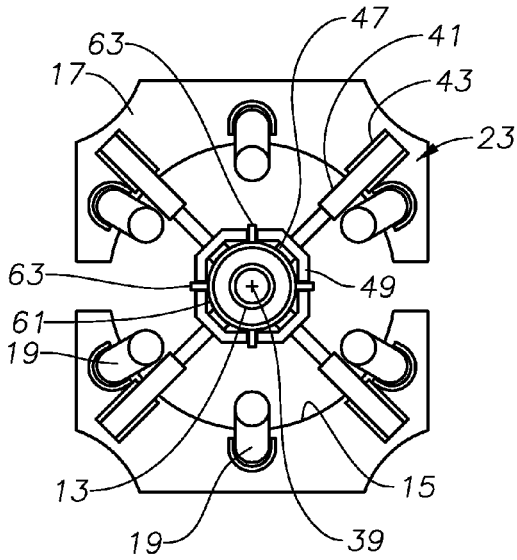

In an alternative embodiment, illustrated in FIGS. 12A and 12B, a conductor sleeve 61 extends axially downward parallel to axis 39 from a lower portion of tensioner ring 21. In the illustrated embodiment, conductor sleeve 61 does not contact the exterior surface of riser 13. Conductor sleeve 61 defines an annular space between the exterior surface of riser 13 and the interior surface of conductor sleeve 61. Ribs 63 are formed in the exterior surface of conductor sleeve 61 and extend the length of conductor sleeve 61 parallel to axis 39. As shown in FIG. 12B, rollers 47 of guide assembly 23 interface with the surface of conductor sleeve 61 between each rib 63. Conductor sleeve 61 has sufficient material strength to resist permanent deformation or failure when experiencing a radial react force exerted by guide assembly 23 as riser 13 tilts. An optional support ring 64 may be coupled to riser 13 within the annulus between conductor sleeve 61 and riser 13 proximate to rollers 47 to provide additional lateral support to conductor sleeve 61. As described above, when riser 13 attempts to shift radially in opening 15 relative to deck 17, rollers 47 of guide assembly 23 will exert a react force against conductor sleeve 61 to constrain the lateral shift in the radial direction. In this manner, riser 13 tilt may be accommodated without allowing for shift of riser 13 in opening 15 that may cause riser 13 to contact deck 17 damaging both deck 17 and riser 13.

Rigid alignment assemblies 49 may mount to the end of each rigid horizontal guide member 41 such that an end of each optional rigid alignment assembly 49 abuts an adjacent rib 63. In this manner, rotation of conductor sleeve 61 is prevented by rigid alignment assemblies 49. As conductor sleeve 61 attempts to rotate relative to deck 17 and riser tensioner assembly 11, ribs 63 will press against rigid alignment assemblies 49. Rigid alignment assemblies 49 will be of a sufficient strength to resist the rotation without significant deformation or failure. Similarly, the coupling of rigid horizontal members 41 to deck 17 at plate 43 will be of a sufficient strength to provide a repetitive react force to the rotation force of conductor sleeve 61 without significant deformation or failure. Rigid alignment assemblies 49 may include rollers on the ends abutting ribs 63 to allow ribs 63 to move axially past rigid alignment assemblies 49. The react rotational force exerted against ribs 63 will prevent riser tensioner assembly 11 from rotating with riser 13. Thus, torque generated in riser tensioner assembly 11 will not transmit to riser 13, and similarly, torque generated in riser 13 will not transmit to riser tensioner assembly 11.

Referring again to FIG. 12A, tensioner ring 21 may clamp to riser 13 as described above with respect to FIGS. 1-11; or alternatively, riser 13 may include a riser tensioner joint 65. Riser tensioner joint 65 will couple inline in riser 13 by any suitable manner such that tensioner joint 65 is proximate to riser tensioner assembly 11. Riser tensioner joint 13 includes a thread 67 on an exterior surface of riser tensioner joint 65. In the embodiment illustrated in FIG. 12A, tensioner ring 21 will have a matching thread 69 formed on an interior diameter surface of tensioner ring 21 so that tensioner ring 21 may be threaded over riser tensioner joint 65 to the position shown in FIG. 12A. If an external force causes riser 13 to rotate relative to deck 17, the rotational force will be reacted to by rigid alignment assemblies 49, ribs 63 of conductor sleeve 61, and the frictional forces at the interface of threads 67, 69. Similarly, if cylinders 35 impart a rotation to riser 13, the rotational force will be reacted to by rigid alignment assemblies 49, ribs 63 of conductor sleeve 61, and the frictional forces at the interface of threads 67, 69. Tilt of riser 13 will still be accommodated as riser 13 may pivot or tilt about the ends of rollers 47 of rigid horizontal members 41 that are in contact with sleeve 61.

Figure 13A:
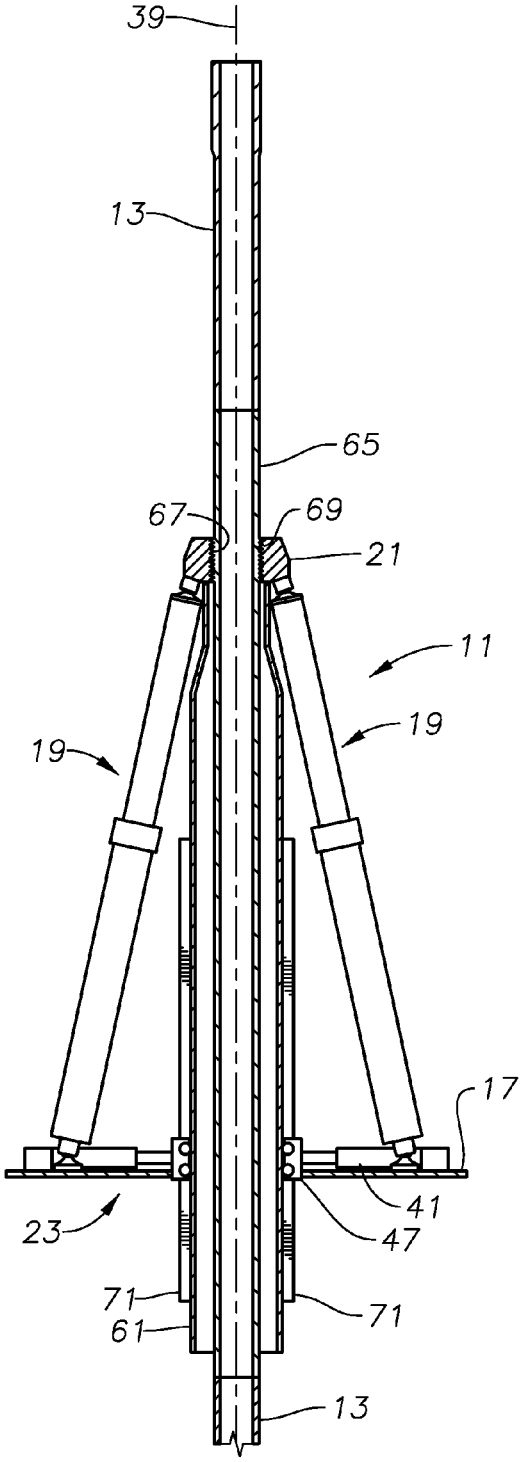
FIGS. 13A-13B are sectional side and top views, respectively, of an alternative embodiment of the riser tensioner assembly of FIG. 1.
Figure 13B:
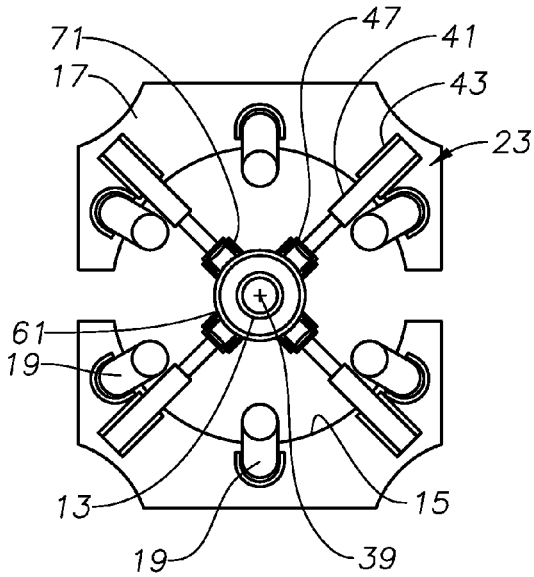

In yet another embodiment, illustrated in FIGS. 13A and 13B, u-shaped channels 71 are formed on the surface of conductor sleeve 61. U-shaped channels 71 extend the axial length of conductor sleeve 61 parallel to axis 39. A roller 47 of each guide assembly 23 will substantially fill a width between legs of each corresponding u-shaped channel 71. Similar to ribs 63 of FIGS. 12A and 12B, rollers 47 will exert a react force to conductor sleeve 61 through u-shaped channels 71 to prevent rotation of conductor sleeve 61. When combined with the threaded tensioner ring 21, u-shaped channels 71 will prevent transfer of rotational motion of riser 13 relative to deck 17, and rotational motion imparted by cylinders 35 to riser 13 in the same manner as ribs 63 of FIGS. 12A and 12B.

Figure 14A:
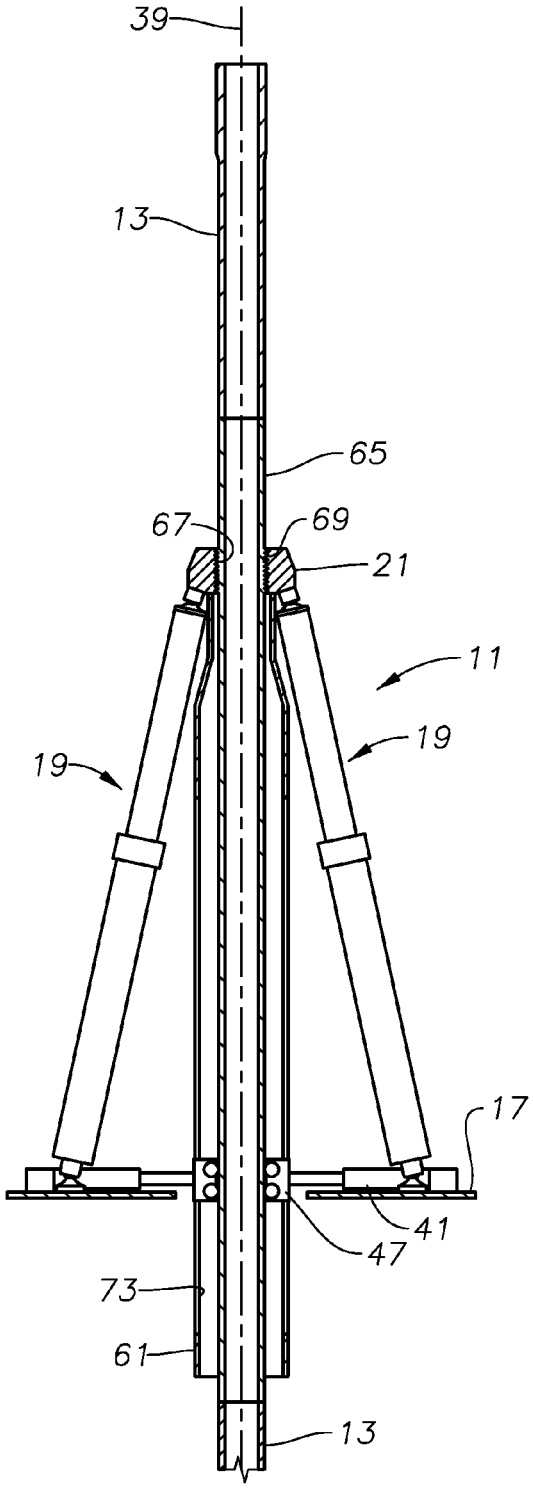
FIGS. 14A-14B are sectional side and top views, respectively, of an alternative embodiment of the riser tensioner assembly of FIG. 1.
Figure 14B:
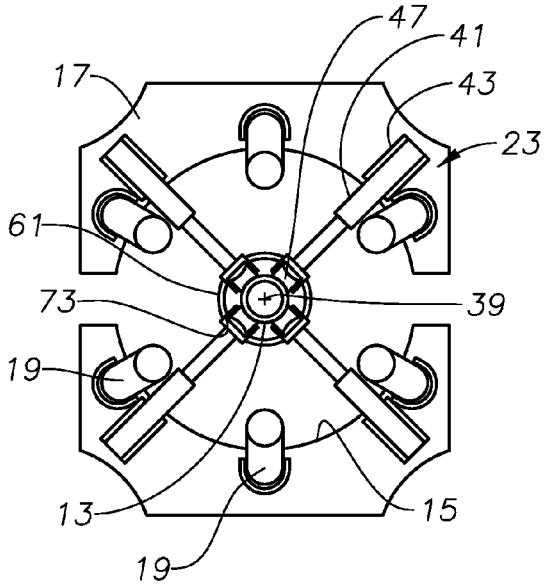

In another alternative embodiment, illustrated in FIGS. 14A and 14B, conductor sleeve 61 defines slots 73 extending from the exterior surface of conductor sleeve 61 to the interior diameter surface of conductor sleeve 61. Slots 73 extend the axial length of conductor sleeve 61 parallel to axis 39. A roller 47 of each guide assembly 23 will substantially fill a width of each slot 73. Similar to ribs 63 of FIGS. 12A and 12B and u-shaped channels 71 of FIGS. 13A and 13B, rollers 47 will exert a react force to conductor sleeve 61 through slots 73 to prevent rotation of conductor sleeve 61. When combined with the threaded tensioner ring 21, slots 73 will prevent transfer of rotational motion of riser 13 relative to deck 17 and rotational motion imparted by cylinders 35 to riser 13 in the same manner as ribs 63 of FIGS. 12A and 12B, and u-shaped channels 71 of FIGS. 13A and 13B.

Figure 9:
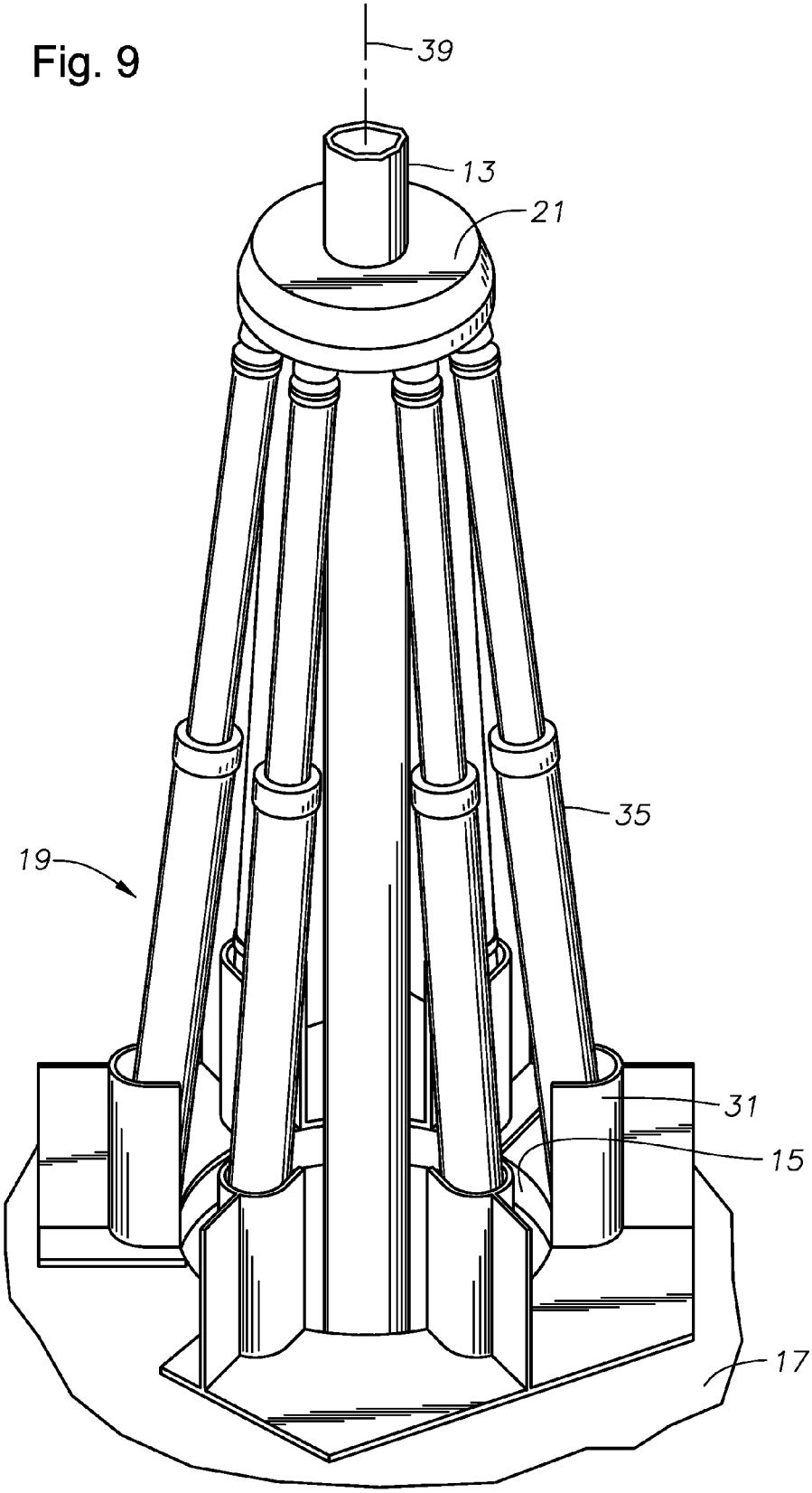

As shown in FIG. 9, once cylinders 35 are rotated in and coupled to tensioner ring 21, riser tensioner assembly 11 maintains an upward axial force on riser 13 by expanding and contracting cylinders 35 of cylinder assemblies 19, such that as deck 17 moves, riser 13 will substantially maintain its position relative to the wellhead assembly (not shown) and the subsea floor. Riser 13 will neither buckle nor separate in response to movement of deck 17. In addition, riser tensioner assembly 11 may accommodate varying tilt of riser 13. As shown in FIG. 10 and FIG. 11, as riser 13 tilts relative to deck 17, such that axis 39 does not meet a horizontal surface plane of deck 17 at a substantially perpendicular angle, cylinders 35 of cylinder assembly 19 will pivot at upper and lower couplers 33, allowing cylinders 35 to maintain engagement with tensioner ring 21.

As shown in FIGS. 10 and 11, each cylinder 35 of cylinder assemblies 19 will either expand or contract a variable amount while pivoting about couplers 33. For example, as shown in FIG. 10, riser 13 is tilted to the left relative to deck 17. Cylinders 35 on the right side portion of FIG. 10 are expanded and pivoted inboard a greater degree than that shown in FIG. 8 and FIG. 9 to accommodate the relative motion between riser 13 and deck 17. Conversely, cylinders 35 on the left side portion of FIG. 10 have contracted and pivoted outboard to a greater degree than that shown in FIGS. 8 and 9 to accommodate the relative motion between riser 13 and deck 17. In this manner, cylinders 35 will continue to exert an axial force on riser 13 that maintains the tension of riser 13. Guide assembly 23 will allow riser 13 to tilt about the ends of rigid horizontal members 41 but not shift radially, thereby preventing riser 13 from contacting or engaging an edge of opening 15 in deck 17 and becoming damaged.

Accordingly, the disclosed embodiments provide numerous advantages over prior art riser tensioners. For example, the disclosed embodiments provide a push up riser tensioner that can accommodate larger loads in a smaller space compared to conventional pull up riser tensioners. In addition, the disclosed embodiments are less prone to corrosion issues due to their placement above the tension leg platform deck rather than below. This also reduces the need for additional deck structure to support the riser tensioner. The disclosed embodiments also eliminate high pressure accumulation while using a smaller number of cylinders. Furthermore, the disclosed embodiments provide a push up tensioner that accommodates riser tilt and may be used in a TLP. The disclosed embodiments also provide a riser tensioner that may be pivoted out of the drilling opening in the platform deck so that equipment larger than the nominal diameter of the riser tensioner may be run on the riser to a subsea location.

It is understood that the present invention may take many forms and embodiments. Accordingly, several variations may be made in the foregoing without departing from the spirit or scope of the invention. Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

What is claimed is:

1. A tensioner for maintaining a tensile force in a riser having an axis and extending from a subsea wellhead assembly through an opening in a floating platform deck, the tensioner comprising:

a tensioner ring adapted to be coupled to the riser and having an axis;

a plurality of hydro-pneumatic cylinders, each having flexible joints on upper and lower ends for coupling the hydro-pneumatic cylinders between the deck and the tensioner ring;

the hydro-pneumatic cylinders being pivotal between a running position, wherein the upper ends of the hydro-pneumatic cylinders are pivoted outward from the axis while the riser is lowered through the opening, and a tensioning position wherein the hydro-pneumatic cylinders are pivoted inward toward the axis and coupled to the tensioner ring; and a plurality of mechanical stops for limiting the outward pivotal movement of the hydro-pneumatic cylinders, each of the mechanical stops adapted to be coupled to the deck outboard from a corresponding one of the hydro-penumatic cylinders.

2. The tensioner of claim 1, wherein:

the plurality of cylinders comprise cylinder pairs, each cylinder pair having a first cylinder and a second cylinder, the lower ends of the first and second cylinders arranged circumferentially around the opening such that the lower end of the first cylinder of each cylinder pair is near the lower end of the second cylinder;

the upper end of the first cylinder couples to the tensioner ring offset from a plane passing through the lower end of the first cylinder and the axis; and the upper end of the second cylinder couples to the tensioner ring offset from a plane passing through the lower end of the second cylinder and the axis, the second cylinder offset equivalent to the first cylinder offset in the opposite direction, thereby causing the first and second cylinders to exert rotational forces in opposite directions.

3. The tensioner of claim 1, wherein:

the mechanical stops are adapted to be coupled to the deck at a position that allows the hydro-pneumatic cylinders to be at least vertically oriented while in the running position.

4. The tensioner of claim 1, further comprising a plurality of extensible fluid placement cylinders, each coupled to one of the hydro-pneumatic cylinders for tilting each hydro-pneumatic cylinder from the running position when the riser is being installed to the tensioning position.

5. The tensioner of claim 1, wherein each of the mechanical stops comprises a curved receptacle for receiving a portion of one of the hydro-pneumatic cylinders while in the running position.

6. The tensioner of claim 1, wherein each of the mechanical stops has a substantially shorter length than each of the hydro-pneumatic cylinders while the hydro-pneumatic cylinders are in contracted positions.

7. The tensioner of claim 1, further comprising a plurality of extensible pivoting devices, each having one end coupled to one of the hydro-pneumatic cylinders and another end adapted to be coupled to the deck for pivoting each hydro-pneumatic cylinder from the running position when to the tensioning position.

8. A tensioner for maintaining a tensile force in a riser extending from a subsea wellhead assembly through an opening in a floating platform deck, the tensioner comprising:

a tensioner ring coupled to the riser and having an axis;

a plurality of hydro-pneumatic cylinders, each having flexible joints on upper and lower ends for coupling the cylinders between the deck and the tensioner ring;

the cylinders being tiltable between a running position wherein the upper ends are tilted outward from the axis to enable the riser to be lowered through the opening and a tensioning position wherein the upper ends are tilted inward toward the axis for engaging the tensioner ring;

a plurality of guidance receptacles mounted to a lower portion of the tensioner ring, each guidance receptacle corresponding to a respective hydro-pneumatic cylinder;

the guidance receptacles each defining an interior cavity adapted to receive the upper end of a respective cylinder; and a plurality of engagement assemblies mounted to the guidance receptacles and the upper ends of the cylinders so that the cylinders will automatically couple to the tensioner ring when the upper end of each cylinder is inserted into a respective interior cavity of one of the guidance receptacles.

9. The tensioner of claim 8, wherein the engagement assemblies comprise:

an annular channel defined by an exterior surface of an upper end of the cylinder;

a lock ring mounted within the annular channel and biased to a radially outward position;

a lock channel defined in an interior diameter surface of the guidance receptacle;

the lock ring and the lock channel having matching mating profiles adapted to allow axial movement upward relative to one another and prevent axial movement downward relative to one another when the lock ring inserts into the lock channel;

a retraction ring circumscribing the upper end of the cylinder axially beneath the lock ring; and the retraction ring adapted to move axially upward and release the lock ring from engagement with the lock channel.

10. A tensioner for maintaining a tensile force in a riser extending from a subsea wellhead assembly through an opening in a floating platform deck, the tensioner comprising:

a tensioner ring for coupling to the riser and having an axis;

a plurality of hydro-pneumatic cylinders having lower ends for coupling to the deck and upper end connect to the tensioner ring;

the hydro-pneumatic cylinders being pivotal between a running position wherein the upper ends are pivoted outward from the axis and a tensioning position wherein the upper ends are tilted inward from the running position toward the axis;

the upper ends of the cylinders adapted to automatically couple to the tensioner ring after moving from the running position to the tensioning position;

a plurality of extensible placement devices, each coupled to one of the hydro-pneumatic cylinders for tilting each hydro-pneumatic cylinder from the running position when the riser is being installed to the tensioning position; and a plurality of mechanical stops for limiting pivot of the upper ends of the cylinders outward from the axis, each mechanical stop adapted to be coupled to the deck outboard from a corresponding cylinder, each mechanical stop having a receptacle to receive one of the hydro-pneumatic cylinders when the hydro-pneumatic cylinder is in the running position.

11. The tensioner of claim 10, further comprising:

a plurality of guidance receptacles mounted to a lower portion of the tensioner ring, each guidance receptacle corresponding to a respective hydro-pneumatic cylinder;

the guidance receptacles each defining an interior cavity adapted to receive the upper end of a respective cylinder;

an annular channel defined by an exterior surface of the upper end of each cylinder;

a lock ring mounted within each annular channel and biased to a radially outward position;

a lock channel defined in an interior diameter surface of each guidance receptacle; and the lock ring and the lock channel having mating profiles to allow axial upward movement relative to one another and prevent axial downward movement relative to one another when the lock ring inserts into the lock channel.

12. The tensioner of claim 10, wherein the mechanical stops are adapted to be coupled to the deck at a position that allows the hydro-pneumatic cylinders to be pivoted outward to at least a vertical orientation while in the running position.

13. The tensioner of claim 10, wherein the upper ends of the hydro-pneumatic cylinders circumscribe an inner diameter at least equal to an inner diameter of the lower ends of the hydro-pneumatic cylinders while in the running position.

14. A method for connecting a riser tensioner to a riser passing through an opening in a deck of a platform comprising:

(a) placing a plurality of hydro-pneumatic cylinders around the opening;

(b) flexibly connecting a lower end of each cylinder to the deck;

(c) positioning upper ends of the cylinders a selected distance outward from an axis of the opening in a running position and lowering the riser through the opening; and (d) attaching a tensioner ring to the riser, tilting the upper ends of the cylinders from the running position inward toward the axis and coupling the upper ends of each cylinder to the tensioner ring, wherein tilting the upper ends inward comprises coupling extensible placement devices to the hydro-pneumatic cylinders and actuating the lacement devices to tilt the hydro-pneumatic cylinders.

15. The method of claim 14, wherein:

step (b) comprises mounting a mechanical stop to the deck outboard from each of the cylinders; and step (c) comprises supporting the cylinders in the running position by the mechanical stops.

16. The method of claim 14, wherein the extensible placement devices in step (d) comprise placement cylinders.

17. The method of claim 14, wherein coupling the upper ends to the tensioner ring in step (d) comprises:

inserting the upper end of each cylinder into a corresponding guidance receptacle mounted to a lower portion of the tensioner ring; and inserting a resilient retainer ring carried on the upper end of each cylinder into a corresponding channel of each guidance receptacle, thereby coupling each cylinder to the tensioner ring.

18. The method of claim 14, wherein while in the running position in step (c) the cylinders are oriented at an angle of at least ninety degrees relative to the deck.

* * * * *